US011207895B2

(12) United States Patent
Wahl et al.

(10) Patent No.: US 11,207,895 B2
(45) Date of Patent: Dec. 28, 2021

(54) METHOD FOR PRINTING ON A SURFACE OF A NON-ABSORBENT SUBSTRATE WITH AN INK TO BE APPLIED BY AN INKJET PRINTING DEVICE, AND DIGITAL PRINTING PRESS FOR CARRYING OUT THE METHOD

(71) Applicant: KOENIG & BAUER AG, Würzburg (DE)

(72) Inventors: Eberhard Wahl, Leonberg (DE); Manuel Komander, Stuttgart (DE); Bernhard Mokler, Markgröningen (DE); Rainer Simon, Steinheim (DE); Dominik Wewior, Leonberg (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/281,619

(22) PCT Filed: Aug. 29, 2019

(86) PCT No.: PCT/EP2019/073110
§ 371 (c)(1),
(2) Date: Mar. 31, 2021

(87) PCT Pub. No.: WO2020/078606
PCT Pub. Date: Apr. 23, 2020

(65) Prior Publication Data

US 2021/0309019 A1 Oct. 7, 2021

(30) Foreign Application Priority Data

Oct. 17, 2018 (DE) ..... 10 2018 125 750.3

(51) Int. Cl.
*B41J 2/205* (2006.01)
*B41J 2/01* (2006.01)
*B41J 11/00* (2006.01)

(52) U.S. Cl.
CPC ..... *B41J 2/205* (2013.01); *B41J 11/0015* (2013.01); *B41J 2/01* (2013.01)

(58) Field of Classification Search
CPC ..... B41J 2/205; B41J 11/0015; B41J 2/01
See application file for complete search history.

(56) References Cited

U.S. PATENT DOCUMENTS 9,573,349 B1 2/2017 Dannhauser et al.
2012/0026264 A1 2/2012 Ikoshi
(Continued)

FOREIGN PATENT DOCUMENTS

CH 703704 A1 3/2012
DE 102012017538 A1 3/2014
(Continued)

OTHER PUBLICATIONS

International Search Report of PCT/EP2019/073110 dated Nov. 27, 2019.

*Primary Examiner* — Yaovi M Ameh
(74) *Attorney, Agent, or Firm* — Mattingly & Malur, PC

(57) ABSTRACT

A method is provided for printing a surface of a non-absorbent substrate with an ink to be applied by an inkjet printing device. An ink that contains water as a solvent is used for printing the substrate. An ink having a water content of at least 70% is used. The substrate to be printed is supported by a workpiece support and is moved relative to the inkjet printing device. During this relative movement, ink is applied by the inkjet printing device to the surface of the substrate to be printed. The ink that is applied to the surface of the substrate is heated to a temperature that is above the temperature of the air surrounding the substrate
(Continued)

and that is below the boiling point of the solvent contained in the ink. Above a liquid phase of the ink, a vapor layer, consisting of the solvent that is contained in the ink, is formed. The vapor layer that is formed above the liquid phase of the ink is transported away by an air flow emitted by at least one blower nozzle unit. The air output by the respective blower nozzle unit is heated or is dehumidified beforehand. A digital printing press is provided for carrying out this method.

15 Claims, 1 Drawing Sheet

(56) References Cited

U.S. PATENT DOCUMENTS

| | | | | |
|---|---|---|---|---|
| 2013/0188000 | A1* | 7/2013 | Kitagishi | B41J 11/06 347/104 |
| 2014/0368590 | A1* | 12/2014 | Shima | B41J 11/002 347/102 |
| 2016/0052302 | A1* | 2/2016 | Willems | C09D 11/322 347/101 |
| 2017/0190188 | A1 | 7/2017 | Kakino et al. | |
| 2018/0236783 | A1 | 8/2018 | Matsuzaki | |
| 2018/0236787 | A1 | 8/2018 | Kagata et al. | |

FOREIGN PATENT DOCUMENTS

| | | | |
|---|---|---|---|
| DE | 102014207709 | A1 | 10/2015 |
| EP | 2617577 | A1 | 7/2013 |
| WO | 2018168675 | A1 | 9/2018 |

* cited by examiner

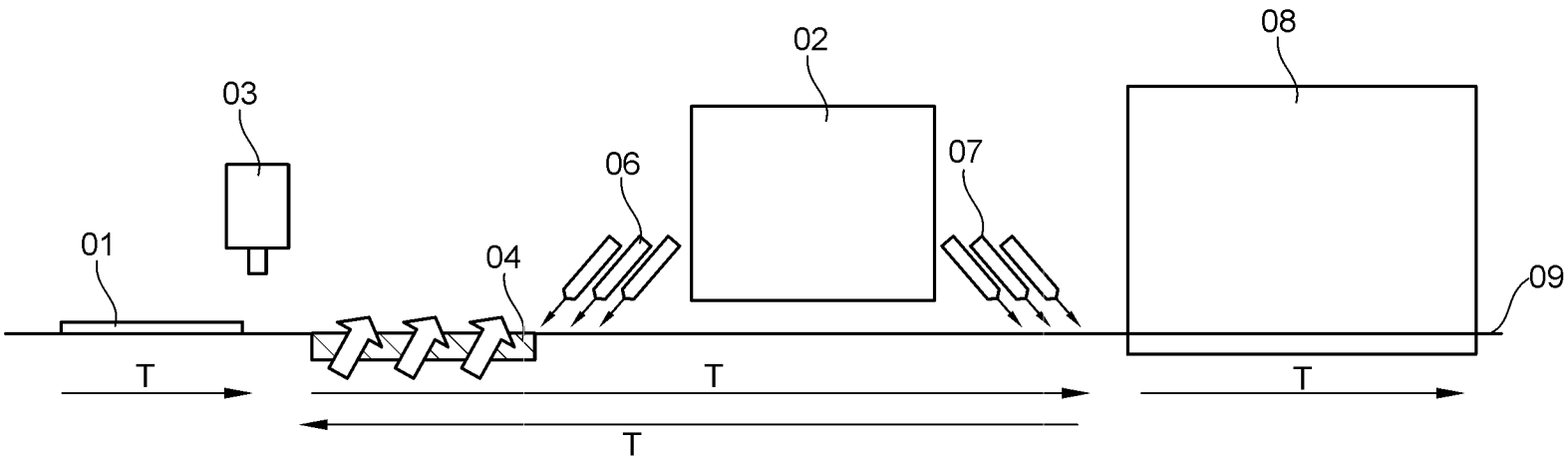
01
02
03
04
06
07
08
09
T
T
T
T

METHOD FOR PRINTING ON A SURFACE OF A NON-ABSORBENT SUBSTRATE WITH AN INK TO BE APPLIED BY AN INKJET PRINTING DEVICE, AND DIGITAL PRINTING PRESS FOR CARRYING OUT THE METHOD

CROSS-REFERENCE TO RELATED APPLICATIONS

This application is the US national phase, under 35 USC § 371, of PCT/EP2019/073110, filed on Aug. 29, 2019; published as WO 2020/078606 A1 on Apr. 23, 2020, and claiming priority to DE 10 2018 125 750.3, filed Oct. 17, 2018, the disclosures of which are expressly incorporated herein in their entireties by reference.

FIELD OF THE INVENTION

The present invention relates to a method for printing the surface of a non-absorbent substrate with an ink to be applied by an inkjet printing device and to a digital printing press for carrying out this method. In the method for printing a surface of a non-absorbent substrate, an ink is to be applied by an inkjet printing device. The ink contains water as a surfactant. An ink having a water content of at least 70% is used, and the substrate to be printed is supported by a workpiece support and is moved relative to the inkjet printing device. During this relative movement, ink is applied by the inkjet printing device to the surface of the substrate to be printed. The ink applied to the surface of the substrate is heated to a temperature that is above the temperature of the air surrounding the substrate and below the boiling point of the solvent contained in the ink. Above a liquid phase of the ink, a vapor layer consisting of the solvent that is contained in the ink, is formed. The vapor layer that is formed above the liquid phase of the ink is transported away by an air flow emitted by at least one blower nozzle unit. The air output by the respective blower nozzle unit is heated or dehumidified beforehand.

BACKGROUND OF THE INVENTION

From EP 2 617 577 A an inkjet recording method is known, in which an image is recorded on a target recording surface that contains polyolefin by the ejection of an ink composition that contains water, a colorant, and resin from nozzles of an inkjet recording head. From WO 2018/168 675 A1, a method for applying an oil-based ink to a substrate that has a resin layer is known, in which the substrate is pretreated to improve its wetting properties prior to the application of the oil-based ink, and is post-treated following the application of the oil-based ink.

From US 2017/0190188 A1, an image recording method is known, in which a recording substrate is subjected to a surface treatment by irradiating an image recording surface of the recording substrate with light from an excimer emission using a xenon gas, the recording substrate being a substrate made of non-absorbent or weakly absorbent fiber materials, and in which an ink composition is applied by an ink jet method to the image recording surface of the recording substrate following the surface treatment.

From US 2018/0236787 A1 an inkjet recording method is known, which comprises the application of a treatment liquid, which has a greater nitrogenous solvent content than that of an ink composition and which has little or no capacity for absorption into the recording medium, wherein surface asperities are greater than or equal to 10 μm, wherein the ink composition, which contains a nitrogenous solvent, is applied by discharging the ink composition from an inkjet head onto the recording medium, the treatment liquid having been applied to the recording medium in advance.

From U.S. Pat. No. 9,573,349 B1, a method for printing non-absorbent substrates with a water-based ink is known, in which ink droplets are applied to the respective substrate, in which the substrates used each have a surface tension of less than 45 mN/m, in which, before the ink droplets are applied, the surface tension of each of the substrates to be printed is increased to a value of at least 45 mN/m, and in which the ink droplets are applied to the respective substrate having the increased surface tension only after the previous steps have been completed.

U.S. 2012/0026264 A1 describes drying a printed substrate by exposing it to heat, e.g., by means of infrared radiation, with a range of 40° C. to 100° C. being proposed for the drying temperature and a range of 0.2 seconds to 10 seconds being proposed for the exposure time.

Known from CH 703704 A1 is a printing device in which at least one printing ink is used for printing onto flat materials in the form of tinplate sheets, wherein the surface tension of said flat materials is lower than the surface tension of the printing ink, said printing device comprising at least one activatable printing unit, and downstream of said at least one activatable printing unit, a final drying system for drying the printing ink that is applied to the flat material by the at least one activatable printing unit; upstream of the first activatable printing unit in the process sequence, at least one irradiation device is provided, with each irradiation device having at least one electromagnetic radiation source for irradiating and increasing the surface tension of the flat material before it is fed to the first activatable printing unit, the radiation source being an elongated UV gas discharge tube or an elongated infrared radiator.

DE 10 2012 017 538 A1 discloses a method for treating the surface of objects with fluids, in which the fluid is applied by means of a first tool, the movement of which is computer controlled, and is then treated further using the second tool, the movement of which is likewise computer controlled; the time lag between the application of the fluid to the object and the subsequent further treatment thereof is adapted to the spreading behavior of the fluid.

SUMMARY OF THE INVENTION

The object of the present invention is to provide a method for printing a surface of a non-absorbent substrate with an ink to be applied by an inkjet printing device, and a digital printing press for carrying out said method, with which method and printing press non-absorbent substrates are printed with a print image of high print quality, in particular avoiding a spreading of the ink droplets, despite the use of a water-based ink.

The object is attained according to the invention by the method for printing a surface of a non-absorbent substrate using an ink which is to be applied by an inkjet printing device, which ink contains water as a surfactant. The ink has a water content of at least 70%. The substrate to be printed is supported by a workpiece support and is moved relative to the inkjet printing device. During this relative movement, the ink is supplied by the inkjet printing device to the surface of the substrate to be printed. The ink, which is applied to the surface of the substrate, is heated to a temperature that is above the temperature of the air which is surrounding the substrate and which is below the boiling point of the solvent contained in the ink. Above a liquid phase of the ink, a vapor layer consisting of the solvent that is applied to the ink, is formed. The vapor layer that is formed above the liquid phase of the ink is transported away by an air flow emitted by at least one blower nozzle unit. The air output by the respective blowing nozzle unit is heated or is dehumidified beforehand. The inkjet printing device has at least one inkjet printhead. Each such printhead ejects the ink in the form of ink droplets. The ink droplets are applied to the respective substrate in a halftone printing process, in each case in a dot density of at least 360 dpi.

The advantages to be achieved with the invention are, in particular, that knowledge of the surface properties of the substrates to be printed that may influence the wetting thereof and that actually exist prior to printing is not necessary; instead, the substrates to be printed are preferably placed in a state of good, i.e. at least partial to very good, i.e., full wettability, immediately prior to printing, while at the same time avoiding, or at least limiting, any possible negative impacts on the printed substrates with this measure.

A further advantage consists in very shallow printing with a low haptic ink buildup, i.e., low relief formation, and in printing with a high gloss level, whereby requirements that are frequently in demand, e.g., in the packaging market, can be met in a simple manner.

Moreover, substrates that have been printed in this manner can be reshaped without undesirable abrasion in the forming machine. Furthermore, good conditions are provided for top-coating and for a low and therefore environmentally friendly ink application with water as an environmentally friendly solvent.

BRIEF DESCRIPTION OF THE DRAWINGS

FIG. 1 is a schematic depiction of the present invention.

DESCRIPTION OF THE PREFERRED EMBODIMENT

In package printing, for example, it may be necessary in an industrial printing process to print on non-absorbent substrates with at least one water-based ink. These substrates are, e.g., flat substrates, in particular, preferably made of a solid material, e.g., substrates made of a metallic material, in particular metal sheets, e.g., made of sheet steel, or a tin plate, or a typically surface-oxidized aluminum material. Alternatively, non-absorbent substrates made, in particular, of prefinished wood, plastic, or a composite material may be used, provided these substrates can be heated during the printing process without sustaining damage, e.g. remaining dimensionally stable. The substrates are preferably configured as panels or sheets, although they may also be, e.g., web-format substrates, or each may be configured as a round body.

Metal substrates, in particular, are typically pre-coated with a primer, e.g. with a white base coat, and/or with a varnish. These substrates specifically have an oiled or greased surface, for example, or a surface that is treated with a corrosion inhibitor. The surface of the substrates to be printed is hydrophobic, in particular. An ink that is pigment-based, for example, in particular is soluble, and has a water content of at least 70%, in particular of at least 80%, is used for printing these substrates. If the substrate in question will be post-processed to produce packaging for foods, an ink that is free of photoinitiators is preferably used. To implement the present invention, e.g., substrates that have a non-polar surface are used, along with a polar ink for printing onto this surface.

The respective ink is applied by an inkjet printing device to the respective substrate in each case in the form of ink droplets, in particular by means of at least one inkjet print head that ejects the ink droplets, with the ink droplets being applied to the substrate in question, e.g., during a monodirectional movement (single pass method) or during a bidirectional movement (multi-pass method) of the print head and/or of the substrate in question. The ink droplets are applied to the respective substrate, e.g., in a halftone printing process, e.g. in each case in a dot density of at least 360 dpi, e.g. of 600 dpi or 1200 dpi. To generate a predetermined print image, the ink droplets are typically applied to the substrate in question in precise positions within a grid comprising a plurality of positions. It is possible for ink droplets of variable size and/or for ink droplets of different shades and/or for ink droplets of different brightness intensities to be applied in each case to the respective substrate. For a multicolor print image composition, color dots from a basic color set, e.g. CMYK, are preferably used.

For the substrates to be printed successfully, the surface tension of the substrates in question must be at least as high as the surface tension of the ink that is used. This is essential in order for the respective surface of the substrates in question to be wetted at least partially with the designated ink. Otherwise, the ink droplets applied to the non-absorbent surface of the relevant substrates will pool together and wetting will be impossible. Thus, insufficient surface tension of the substrates in question will result in a printed image that is at least unclear, and more particularly is blurred or faint or not color-true, and thus is not usable, if any printed image can be produced at all. The surface tension of the substrates in question and the surface tension of the ink that is used are typically temperature-dependent. Other environmental conditions, e.g., humidity, or certain surface properties of the substrates in question, such as their roughness and/or their pretreatment and/or their degree of soiling, also affect the wettability of the respective surface of these substrates.

The surface tension of solid substrates can be determined, e.g., using commercially available test inks. The surface tension of a water-based ink can be determined, e.g., by the ring method of Lecomte De Noüy, or by the plate method of Wilhelmy, or by the frame method of Lenard using a tensiometer, or by the capillary effect, or can be determined approximately by comparative measurement using test inks.

At room temperature, e.g., in ambient air at a temperature of 20° C., e.g., the following values for surface tension can be assumed for metallic substrates in solid form, i.e., in particular for metal sheets:

| | |
|---|---|
| untreated steel | 29 mN/m |
| aluminum (oxide) | 33-35 mN/m |
| tin-plated steel | approx. 35 mN/m |
| phosphated steel | 43-46 mN/m |

Oiled or greased surfaces have a surface tension of about 30 mN/m.

In the following, it is assumed that the substrates used each have a surface tension in air at a temperature of 20° C. of less than 50 mN/m, for example, preferably of less than 45 mN/m. Thus, at the same room temperature of 20° C., for example, the surface tension of the substrates provided for printing is typically lower than the surface tension of the water contained as a solvent in the ink, and is also typically lower than the surface tension of the ink itself that is used for printing.

Water at standard pressure (SATP), i.e., at 0.1 MPa corresponding to 1 bar, has a surface tension of 72.74 mN/m at a temperature of 20° C., and has a surface tension of 67.95 mN/m at a temperature of 50° C.

To achieve good printing results it is therefore provided that in the machine used to carry out the printing process, e.g. in a printing press, in particular in a digital printing press that operates without printing formes and that has at least one inkjet print head, before the ink droplets are applied to the surface of the substrate to be printed, the surface tension of said surface is increased, e.g., by at least 10%, preferably by more than 40%, in each case to a value of at least 45 mN/m, in particular to a value of at least 50 mN/m, preferably to a value of more than 70 mN/m. Only after this increase in surface tension, i.e. once the surface tension of the surface of the substrate to be printed is high enough, are the ink droplets applied to the respective substrate, the surface tension of which has typically been increased.

To improve the wettability of non-absorbent, in particular metal surfaces that are to be printed with a water-based ink, the surface tension of the substrates in question can be increased, e.g., by phosphating these substrates and/or by applying a suitable coating, e.g., by applying a white base coat and/or a special coating. Alternatively or additionally, the surface tension of the substrates in question may be increased by pretreating them in a corona process or a plasma process or a chemical process, or by flame treatment or by UV irradiation or by some other surface activation technique. In increasing the surface tension of the substrates to be printed, the goal is to set a value that not only reaches, but in most cases significantly exceeds a minimum value for the preferably full wettability of the surface of said substrates.

Increasing the surface tension of the substrates in question beyond the minimum value for wettability leads in most cases to a pronounced spreading of the ink droplets applied to the surface thereof, i.e., to an undesirable spreading of these ink droplets on the surface of said substrates. The spreading of ink droplets will result in the color characteristic of the printed image changing very rapidly and/or may also lead to an unwanted flow of ink, e.g., into micro-depressions in the substrate in question. A further effect that occurs when ink droplets of different shades are used involves a bleeding of these ink droplets, which results, e.g., from a merging of different color dots and thus leads to highly undesirable color effects in the printed image; these affect not only the color, but also the sharpness of the contours of printed structured areas, e.g., in a font or along the edge of an image.

It is therefore advantageous for the spreading of ink droplets to be halted or even largely prevented, preferably immediately, i.e., within only one second and preferably within 0.5 seconds, after the substrates are printed, by means of an abrupt, in particular, (over) drying of the ink droplets. This occurs in direct spatial proximity to the inkjet printer. In a binder-based ink, this drying causes the at least one binder to gel, thereby likewise preventing or halting a spreading of the ink droplets on the substrate in question. The abrupt (over) drying of the ink droplets to stop or prevent them from spreading is also referred to as pinning. Pinning fixes the ink droplets that have been applied to the substrate in their respective position on the surface of the substrate to be printed.

FIG. 1 illustrates the proposed method for printing a surface of a non-absorbent substrate 01 with an ink to be applied by an inkjet printing device 02. The substrate 01 is printed in an industrial printing process, preferably by a digital printing press that has at least one inkjet printing device 02, and for this purpose is transported, e.g. along a transport path 09. In the direction of transport T of the substrate 01, indicated by directional arrows, a device 03 for pretreating the substrate 01 to be printed, in the form of a device for increasing the surface tension of the surface of the substrate 01 to be printed, is typically arranged first; said pretreating device 03 increases the surface tension of the surface of the substrate 01 to be printed, at least up to the value that corresponds to the surface tension of the ink to be applied to the surface of the substrate 01 by the inkjet printing device 02. This device 03 for increasing the surface tension of the surface of the substrate 01 to be printed performs a pretreatment of the substrate 01 to be printed, e.g. in a corona process or a plasma process or a chemical process or by flame treatment or by UV irradiation.

The substrate 01 to be printed is laid flat, for example, on a workpiece support 04, which is configured, e.g. as tabular and which cooperates with the inkjet printer 02. The inkjet printing device 02 and the workpiece support 04 are configured and are arranged relative to one another such that the substrate 01 to be printed that is carried by the workpiece support 04 executes a movement relative to the inkjet printing device 02, or such a relative movement is at least possible, and during this relative movement, ink is applied by the inkjet printing device 02 to the surface of the substrate 01 to be printed. The ink can be applied to the surface of the substrate 01 during a monodirectional movement (single pass method) or during a bidirectional movement (multi pass method) of either the inkjet printing device 02 or the workpiece support 04.

According to the invention, the workpiece support 04 is heated to a temperature above the air temperature surrounding it, and the substrate 01 supported by the workpiece support 04 is in turn heated, e.g. by the thermal conduction of the workpiece support 04, within a very short time, e.g. within the range of less than 1 second, preferably even within the range of a few milliseconds, i.e. in less than 50 ms, in particular in less than 10 ms, with the result that the ink applied to the surface of the substrate 01 is also heated, in particular by the thermal conduction of the substrate 01 that is heated by the workpiece support 04, in practically just as short a time, possibly with a permissible deviation, i.e. a tolerance of no more than 5° C., preferably a maximum of 2° C., in particular to, e.g., at least 90% of the increased temperature of the heated workpiece support 01. The ink applied to the substrate 01 is thereby exposed virtually suddenly to a temperature that is significantly higher than the temperature of the air surrounding the substrate 01. The temperature of the ink applied to the substrate 01 is above the temperature of the air surrounding the substrate 01, but below the boiling point of the solvent contained in the ink, with water being used as the solvent contained in the ink. The heating of workpiece support 04, substrate 01, and the ink applied thereto is indicated in FIG. 1 by arrows pointing diagonally upward. The workpiece support 04 is preferably heated by a heating device with which the temperature to be set for said workpiece support preferably is or at least can be controlled.

This heating of the ink applied to the substrate 01 results in the formation of a vapor layer above the liquid phase of said ink. This is due to the fact that as the temperature rises, volatile constituents of the ink, which are primarily the solvent, i.e. in particular the water, contained in the ink, increasingly tend to transition from the liquid phase of the ink to a gaseous phase, resulting in the vapor. The vaporization below the boiling point of the solvent contained in the ink, i.e. particularly the water, is also referred to as evaporation. The vaporization rate and the vapor pressure prevailing in the vapor are also dependent on the material composition of the ink and on its rheological properties, among other things. In the arrangement described above, however, they can also be influenced by the surface tension of the ink and/or by the surface tension of the substrate 01 bearing the ink and the temperature thereof.

The embodiment according to the invention provides for the vapor layer that forms above the liquid phase of the ink to be transported away by an air flow and thereby removed. The air flow is supplied by at least one blower nozzle unit 06; 07, with the respective blower nozzle unit 06; 07 emitting the air flow in the direction of the substrate 01 under ambient conditions around the press. The air output by the respective blower nozzle unit 06; 07 is typically heated and/or dehumidified beforehand. Thus, a heating device, preferably controlled or at least controllable in terms of the temperature to be set, can be arranged, e.g. in the inflow of each respective blower nozzle unit 06; 07. The respective blower nozzle unit 06; 07 can also be augmented with at least one, e.g. linear heating device, with each respective heating device being configured, e.g. as a radiation source in the IR or near IR range and/or as an LED emitter. The relative humidity of the air flow emitted by the respective blower nozzle unit 06; 07 is preferably less than 65%. The air flow supplied by the respective blower nozzle unit 06; 07 has a flow rate of more than 25 m/s, for example, preferably more than 30 m/s, in particular more than 50 m/s, or even more than 100 m/s. This air flow is directed toward the substrate 01 bearing the ink at an angle of, e.g. 0° to 90°, preferably within a range of 30° to 45°, from the support plane of said substrate 01 lying on the workpiece support 04, with said air flow preferably being aligned with the direction of transport T of the substrate 01 in question. An air outlet opening of the respective blower nozzle unit 06; 07, preferably configured as a slot extending transversely to the direction of transport T of the substrate 01 in question, is arranged in each case at a distance of 0.1 mm to 10 mm, preferably 2 mm, above the printed surface of said substrate 01. The air flow supplied by said blower nozzle unit 06; 07 removes the vapor layer that has formed above the liquid phase of the ink, but does not displace the respective ink droplets applied to the substrate 01. With a monodirectional relative movement (single pass method) between substrate 01 and inkjet printing device 02, e.g. a single blower nozzle unit 07 immediately downstream of the inkjet printing device 02 in the direction of transport T of said substrate 01 is sufficient. With a bidirectional relative movement (multi-pass method) between substrate 01 and inkjet printing device 02, it is advantageous for one blower nozzle unit 06; 07 to be positioned immediately upstream of the inkjet printing device 02 and one immediately downstream of said device, for the intermediate drying of the substrate 01 in question and/or the ink applied to the surface of the substrate 01 (FIG. 1). In a further embodiment, the blower nozzle units 06; 07 may be positioned not only upstream and downstream of the inkjet printing device 02, but also between individual segments and/or between nozzles of said inkjet printing device 02 that apply differently colored inks, in order to enable an even more immediate intermediate drying of the individual ink applications.

As described above, it is advantageous for the ink applied to the surface of the substrate 01 to be dried within only a single second following its application to the substrate 01 in question, e.g. by a transfer of heat into the substrate 01 in question and/or into the applied ink, in an intermediate drying step that is different from the thermal conduction of the workpiece support 04, with this intermediate drying preferably being implemented by means of at least one blower nozzle unit 06; 07. Afterward, the substrate 01 bearing the intermediately dried ink is fed to an end dryer 08 (hot air and/or IR), which is typically conventional and is separated spatially from the inkjet printing device 02; said substrate is passed through this end dryer 08, for example, with this final drying step finally effecting a complete physical drying and, if applicable, crosslinking of the ink. The intermediate drying of the applied ink is carried out, in particular by the respective blower nozzle unit 06; 07, during the printing process, i.e. practically at the same time as the printing process, immediately after or before the printing passes, and is inextricably linked to the printing process. In the preferred embodiment, the intermediate drying of the ink application is supported and/or intensified by a heating of the substrate 01. The air flow emitted by the respective blower nozzle unit 06; 07, preferably in the form of a jet, is applied to the surface of the substrate 01 and typically dries an entire region of said substrate 01. The flow rate of the air flow supplied by the respective blower nozzle unit 06; 07 determines the intensity of drying of the ink applied to the surface of the substrate 01, with this intensity decreasing with the distance from the preferably slot-shaped air outlet opening of the respective blower nozzle unit 06; 07. In a preferred embodiment, each respective blower nozzle unit 06; 07 has multiple air outlet openings, preferably each configured, e.g. in the form of a slot extending transversely to the direction of transport T of the substrate 01 in question, and lying one behind the other in the direction of transport T of said substrate 01. The intermediate drying of the substrate 01 in question and/or the ink applied to the surface of the substrate 01 can be intensified by one or more heating devices arranged, in particular, in the region of the inkjet printing device 02, wherein each relevant heating device is configured, e.g., as a radiation source in the IR or near IR range and/or as an LED emitter and is arranged, e.g. immediately upstream or downstream of the inkjet printing device 02 in the direction of transport T of the relevant substrate 01, inside and/or outside of the respective blower nozzle unit 06; 07.

While a preferred embodiment of a method for printing on a surface of a non-absorbent substrate with an ink to be applied by an inkjet printing press device and a digital printing press for carrying out the method, all in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A method for printing a surface of a non-absorbent substrate (01) with an ink to be applied by an inkjet printing device (02), in which an ink that contains water as a solvent is used for printing the substrates (01), wherein an ink having a water content of at least 70% is used, and in which the substrate (01) to be printed is supported by a workpiece support (04) and is moved relative to the inkjet printing device (02), wherein during this relative movement, ink is applied by the inkjet printing device (02) to the surface of the substrate (01) to be printed, wherein the ink applied to the surface of the substrate (01) is heated to a temperature that is above the temperature of the air surrounding the substrate (01) and below the boiling point of the solvent contained in the ink, wherein above a liquid phase of the ink, a vapor layer consisting of the solvent that is contained in the ink is formed, wherein the vapor layer that is formed above the liquid phase of the ink is transported away by an air flow emitted by at least one blower nozzle unit (06; 07), wherein the air output by the respective blower nozzle unit (06; 07) is heated and/or dehumidified beforehand, characterized in that the workpiece support (04) is heated to a temperature that is above the temperature of the air surrounding it, wherein the substrate (01) supported by the workpiece support (04) and the ink applied to the surface of the substrate (01) are each heated by the thermal conduction of the workpiece support (04) to the increased temperature of the workpiece support (04), with a permissible deviation, wherein the substrate (01) supported by the workpiece support (04) and the ink applied to the surface of the substrate (01) are each heated by the thermal conduction of the workpiece support (04) to the increased temperature of the workpiece support (04), with a permissible deviation of no more than 5° C. and/or to at least 90% of the increased temperature of the workpiece support (04).

2. The method according to claim 1, characterized in that the air flow is emitted by the respective blower nozzle unit (06; 07) with a relative humidity of less than 65%, and/or in that the air flow is emitted by the respective blower nozzle unit (06; 07) at a flow rate of more than 25 m/s.

3. The method according to claim 1, characterized in that the air flow emitted by the respective blower nozzle unit (06; 07) is directed toward the substrate (01) bearing the ink, at an angle of 0° to 90° from a support plane of the substrate (01) in question, which is supported by the workpiece support (04), and/or in that the air flow emitted by the respective blower nozzle unit (06; 07) is aligned with the direction of transport (T) of the substrate (01) in question.

4. The method according to claim 1, characterized in that the air flow emitted by the respective blower nozzle unit (06; 07) is emitted from multiple air outlet openings lying one behind the other in the direction of transport (T) of the substrate (01) in question, and/or in that the air flow supplied by the respective blower nozzle unit (06; 07) is emitted from at least one air outlet opening, each such opening being in the form of a slot extending transversely to the direction of transport (T) of the substrate (01) in question, and/or in that the air flow supplied by the respective blower nozzle unit (06; 07) is emitted from air outlet openings arranged between individual segments and/or from air outlet openings arranged between nozzles of the inkjet printing device (02) that apply differently colored inks.

5. The method according to claim 1, characterized in that air is blown onto the substrate (01) in question, which is supported by the workpiece support (04), from at least one air outlet opening of the respective blower nozzle unit (06; 07), each such opening being arranged at a distance of 0.1 mm to 10 mm above the printed surface of the substrate (01) in question.

6. The method according to claim 1, characterized in that a heating device arranged in the respective blower nozzle unit (06; 07) is controlled in terms of the temperature to be set.

7. The method according to claim 1, characterized in that the respective blower nozzle unit (06; 07) performs an intermediate drying of the substrate (01) in question and/or of the ink that is applied to the surface of the substrate (01).

8. The method according to claim 7, characterized in that the intermediate drying of the substrate (01) in question and/or of the ink that is applied to the surface of the substrate (01) is intensified by one or more heating devices arranged in the region of the inkjet printing device (02).

9. The method according to claim 8, characterized in that heating devices arranged immediately downstream of the inkjet printing device (02) in the direction of transport (T) of the substrate (01) in question are used.

10. The method according to claim 8, characterized in that heating devices arranged inside and/or outside of the respective blower nozzle unit (06; 07) are used.

11. The method according to claim 1, characterized in that following the printing process, the substrate (01) bearing the ink is fed to an end dryer (08), which is spatially separate from the inkjet printing device (02), wherein a hot air end dryer and/or an IR end dryer (08) is used as the end dryer (08).

12. The method according to claim 1, characterized in that the ink is applied to the surface of the substrate (01) in question during a monodirectional relative movement between the substrate (01) and the inkjet printing device (02) (single pass method), or in that the ink is applied to the surface of the substrate (01) in question during a bidirectional relative movement between the substrate (01) and the inkjet printing device (02) (multi-pass method).

13. The method according to claim 1, characterized in that the workpiece support (04) is heated by a heating device, wherein the temperature to be set for the workpiece support (04) is controlled.

14. The method according to claim 1, characterized in that the surface tension of the surface of the substrate (01) to be printed is increased at least to the specific value that corresponds to the surface tension of the ink to be applied to the surface of the substrate (01) by the inkjet printing device (02), wherein the surface tension of the surface of the substrate (01) to be printed is increased in a device (03) for pretreating the substrate (01) to be printed, wherein the substrate (01) to be printed is pretreated by said device (03) in a corona process or in a plasma process or in a chemical process or by flame treatment or by UV irradiation.

15. The method according to claim 1, characterized in that at least one inkjet print head, each such print head ejecting the ink in the form of ink droplets, is used as the inkjet printing device (02), wherein the ink droplets are applied to the respective substrate (01) in a halftone printing process, in each case in a dot density of at least 360 dpi.

* * * * *